United States Patent [19]

Hoover

[11] 4,337,687

[45] Jul. 6, 1982

[54] POPPET TRIP DEVICE FOR HYDRAULIC CYLINDERS

[75] Inventor: Robert A. Hoover, Sioux City, Iowa

[73] Assignee: Prince Manufacturing Corporation, Sioux City, Iowa

[21] Appl. No.: 152,850

[22] Filed: May 23, 1980

[51] Int. Cl.[3] ..... F15B 15/22

[52] U.S. Cl. ..... 91/401; 92/164

[58] Field of Search ..... 91/401, 229; 92/164

[56] References Cited

U.S. PATENT DOCUMENTS

| | | | |
|---|---|---|---|
| 1,699,917 | 1/1929 | Pomeroy | 91/401 |
| 2,709,420 | 5/1955 | Fullwood et al. | 91/401 |
| 3,182,563 | 5/1965 | Nerlon | 91/401 |
| 3,448,658 | 6/1969 | Arnes | 91/401 |
| 3,515,224 | 6/1970 | Seabevg | 91/401 |

FOREIGN PATENT DOCUMENTS

| | | | |
|---|---|---|---|
| 1062300 | 12/1953 | France | 91/401 |

*Primary Examiner*—Paul L. Maslousky

*Attorney, Agent, or Firm*—Zarley, McKee, Thomte, Voorhees & Sease

[57] ABSTRACT

The poppet trip device of the present invention is adapted for hydraulic cylinder units having a poppet axially movable within a poppet sleeve extended through the piston of the hydraulic cylinder unit. A head end of the poppet extends outwardly from the piston for engaging the head end of the cylinder in response to movement of the piston to the cylinder head end whereby the poppet is unseated and fluid communication is established through the poppet sleeve. Since the piston is spaced from the free end of the piston rod, however, engagement of the piston rod with the base end of the cylinder leaves the base end of the poppet spaced from the cylinder base end. The trip device or contact member of the present invention therefore is supported between the cylinder base end and piston for engaging the base end of the poppet in response to movement of the piston rod to the cylinder base end whereby the poppet is unseated and fluid communication is established through the poppet sleeve.

12 Claims, 7 Drawing Figures

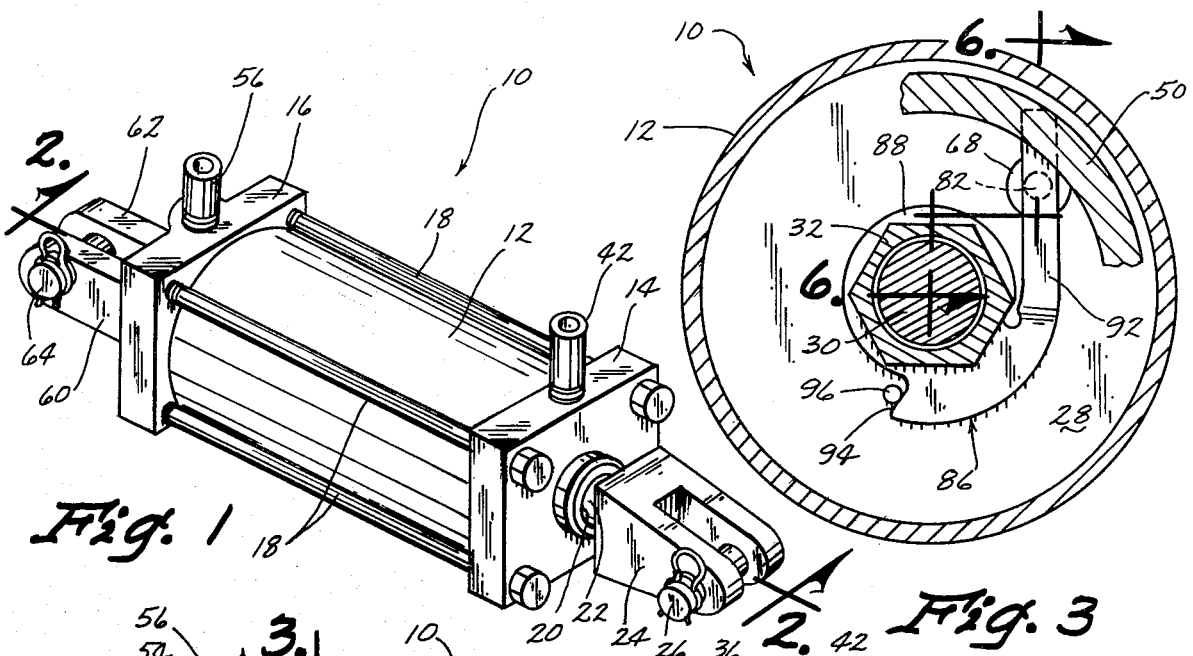
Fig. 1
Fig. 3
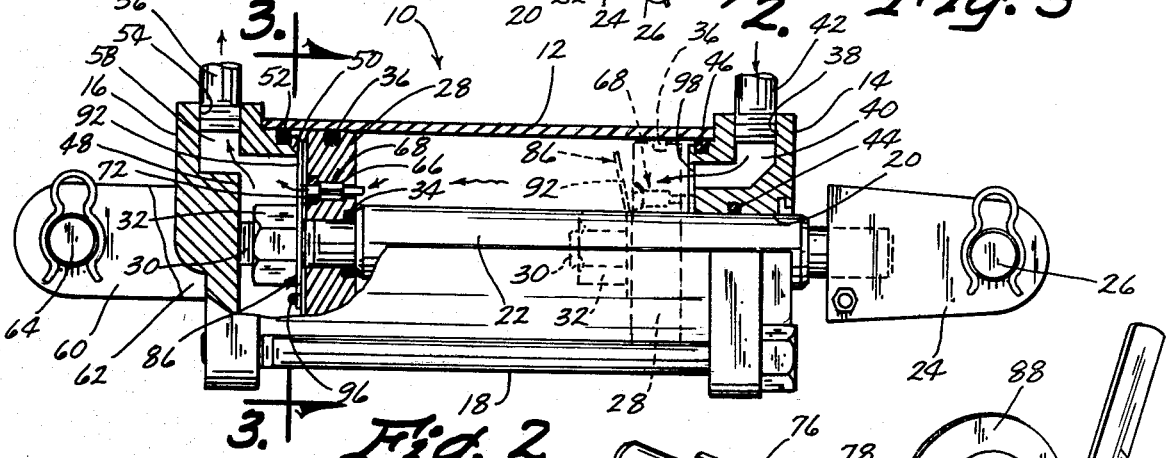
Fig. 2
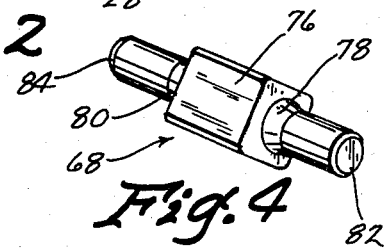
Fig. 4
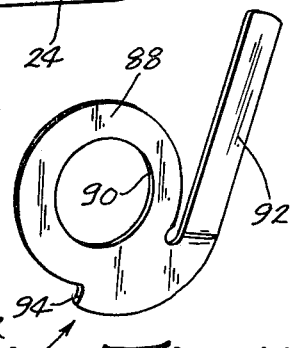
Fig. 5
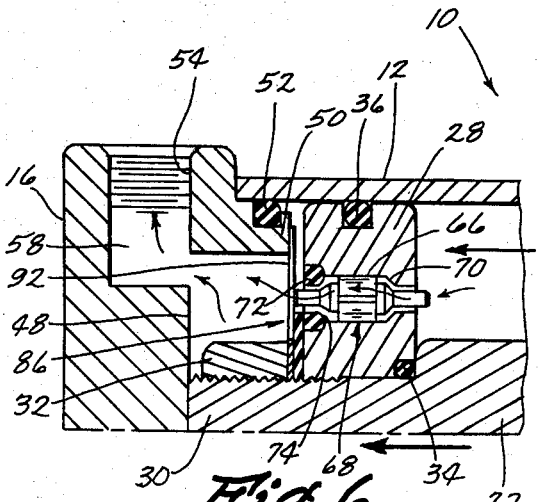
Fig. 6
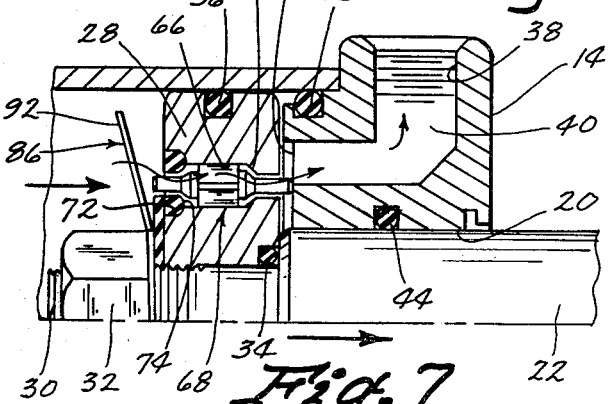
Fig. 7

POPPET TRIP DEVICE FOR HYDRAULIC CYLINDERS

BACKGROUND OF THE INVENTION

The present invention relates generally to hydraulic cylinder units and more particularly to a device for tripping the poppet of a hydraulic cylinder unit piston to enable synchronization.

It has become desirable in various industries to have hydraulic cylinders that move in synchronization with each other, whether it be a retracting motion or an extending motion or both. Such a set of cylinders are referred to as series cylinders.

To insure that the set of cylinders do not get out of synchronization due to volume differentials inherent within the cylinders, a means to bypass fluid around the piston at the end of either the retracting and/or extending motion must be incorporated into the hydraulic cylinders.

A known type of series cylinder in the prior art includes a poppet in the piston rod, the poppet being tripped when it strikes the end of the cylinder butt plate. But this means for bypassing fluid across the piston is expensive to manufacture and difficult to assemble and maintain.

Another problem associated with series cylinders of the prior art is that they have generally been highly susceptible to contamination. This is because the poppet seat mechanisms have been formed of a relatively soft material so that the high velocity fluid passing through the poppet tends to embed foreign matter into the valve seats.

These and other problems of the prior art are believed to be resolved by the poppet trip device of the present invention.

Accordingly, a primary object of the present invention is to provide an improved series cylinder.

Another object is to provide a series cylinder including a movable poppet installed within the piston thereof.

A further object is to provide such a series cylinder including means for tripping or unseating the poppet at both ends of the hydraulic cylinder unit.

A further object is to provide such a series cylinder including means for enabling a piston mounted poppet to indirectly contact the base end of the cylinder for tripping the poppet.

Another object is to provide an hydraulic cylinder poppet trip device which is easy and economical to manufacture and easy to assemble and maintain.

A further object is to provide a series cylinder poppet trip device which has little or no susceptibility to contamination.

SUMMARY OF THE INVENTION

The poppet trip device of the present invention is adapted for hydraulic cylinder units wherein a movable poppet is installed within the piston thereof. At the head end of the cylinder, through which the piston rod extends, the poppet is tripped by direct engagement with the cylinder head end thereby to unseat the poppet and provide fluid communication through the poppet sleeve. At the base end of the hydraulic cylinder unit, however, the poppet is spaced from the cylinder base end because of the retaining nut on the end of the piston rod. Accordingly, the present invention provides a poppet trip device or contact member which is supported within the cylinder between the base end and piston for engagement with the poppet in response to movement of the piston rod to the cylinder base end thereby to unseat the poppet and establish fluid communication through the poppet sleeve.

The contact member is preferably carried on the piston rod and secured between the piston and retaining nut. The contact member may be a spring clip having an outwardly extended arm biased toward the cylinder base end but deflectable toward the piston for tripping the poppet when the arm engages the base end of the cylinder.

BRIEF DESCRIPTION OF THE DRAWINGS

FIG. 1 is a perspective view of an hydraulic cylinder unit equipped with the poppet device of the invention;

FIG. 2 is an enlarged side sectional view taken along line 2—2 in FIG. 1;

FIG. 3 is a further enlarged transverse sectional view taken along 3—3 in FIG. 2;

FIG. 4 is a perspective view of the movable poppet within the piston;

FIG. 5 is a perspective view of the poppet trip device;

FIG. 6 is an enlarged partial sectional view showing the poppet trip device engaging the base end of the cylinder and tripping the poppet; and FIG. 7 is an enlarged partial sectional view showing the poppet engaging the head end of the cylinder.

DESCRIPTION OF THE PREFERRED EMBODIMENT

A hydraulic cylinder unit 10, shown in FIGS. 1 and 2, includes an elongated cylinder 12 having a head end 14 and base end 16 secured to the opposite ends thereof by a set of elongated bolts 18. The head end 14 includes an opening 20 through which the piston rod 22 is axially slidably received as shown best in FIG. 2. A clevis 24 having a removable pin 26 is secured onto the exterior end of the piston rod 22. A piston 28 is secured onto a reduced diameter interior end portion 30 of piston rod 22 by a retaining nut 32. Seal rings 34 and 36 provide a fluid tight seal between the piston 28 and the piston rod 22 and cylinder 12 respectively.

The head end 14 of hydraulic cylinder unit 10 includes a hydraulic fluid port 38 which communicates through a passageway 40 with the interior of cylinder 12. A suitable fitting 42 is secured within port 38 for selective connection through a suitable valve to either a hydraulic fluid reservoir or source of hydraulic fluid under pressure. Head end 14 carries a pair of seal rings 44 and 46 which engage the piston rod 22 and inner surface of cylinder 12 respectively.

The base end 16 of hydraulic cylinder unit 10 includes what shall be referred to as a butt plate portion 48 extending transversely across the end of the cylinder 12 and an annular base end cap flange 50 which extends axially into one end of cylinder 12 interiorly of butt plate portion 48. A seal ring 52 carried on flange 50 provides a fluid type seal between the flange and cylinder 12. Base end 16 is also provided with a hydraulic fluid port 54 equipped with a fitting 56 for providing fluid communication through a passageway 58 to the interior of cylinder 12. A pair of ears 60 and 62 extend outwardly from base end 16 for supporting a removable clevis pin 64 in the usual manner.

Referring to FIGS. 2, 6 and 7, it is seen that a poppet sleeve or bore 66 is generally axially extended through the piston 28 for slidably supporting a poppet 68 therein. Poppet sleeve 66 has a reduced diameter head end forming a tapered valve seat at 70. The base end of poppet sleeve 66 is adapted to receive an annular plug 72 which forms another valve seat 74.

Poppet 68, in the preferred embodiment of FIG. 4, includes a central body portion 76 which is formed of square section stock having the edges rounded so as to be both rotatably and axially slidably supported within the poppet sleeve 66 while permitting fluid passage axially of the poppet between the flats thereof and the cylindrical sleeve 66. Body portion 76 is somewhat shorter than the distance between valve seats 70 and 74 and tapers inwardly at its ends to define valve heads 78 and 80 respectively. Reduced diameter head and base ends 82 and 84 of poppet 68 extend axially from the valve head to give the poppet an overall length somewhat greater than the thickness of piston 28.

The poppet trip device of the present invention comprises a spring clip 86 shown in perspective in FIG. 5. Spring clip 86 includes a flat annular portion 88 having an opening 90 for receiving the piston rod 22.

Spring clip 86 further includes an arm 92 extended outwardly from flat portion 88 at an inclined angle to the plane of the flat portion. Finally, spring clip 86 includes a peripheral shoulder 94 which cooperates with a stop pin 96 (FIG. 3) on the base end of piston 28 to positively position the spring clip relative to the piston and prevent rotation of the spring clip. It is seen in FIGS. 6 and 7 that the spring clip 86 is fitted onto piston rod 22 and sandwiched between the piston 28 and retaining nut 32 so that arm 92 extends radially outwardly from piston rod 22 and toward the cylinder base end 16. It is seen in FIG. 3 that when shoulder 94 engages stop pin 96, the spring clip arm 92 is positioned for registration with the poppet 68 as described hereinbelow.

In operation, it is desirable to bypass hydraulic fluid through the poppet sleeve 66 of piston 28 at the end of the extension, retraction or both motions of the piston in order to synchronize hydraulic cylinder unit 10 with another hydraulic cylinder unit which coacts in series. Referring first to the extension motion of the hydraulic cylinder unit 10, hydraulic fluid under pressure is introduced into the base end port 54 which causes the poppet 68 to be seated against valve seat 70 and the piston to move to its extended position in engagement with head end 14. It is seen in FIG. 7 that when the piston 28 engages head end 14, the head end 82 of poppet 68 also engages the head end so as to unseat the poppet and establish hydraulic fluid communication through the poppet sleeve 66. Note that the cylinder head end 14 includes an annular recess at 98 to permit fluid communication from the poppet sleeve 66 to passageway 40 and port 38.

Upon retraction of the hydraulic cylinder unit 10, hydraulic fluid under pressure is introduced through port 38 and passageway 40 to seat the poppet against the opposite valve seat 74 and move the piston to the left as seen in FIGS. 2 and 6 into engagement with the base end cap flange 50. Since the butt plate portion 48 of the cylinder base end 16 is recessed inwardly of the base end cap flange 50 to accommodate the retaining nut 32, the base end 84 of poppet 68 remains in spaced relation from the cylinder base end. But as the piston 28 approaches its retracted position, the spring clip arm 92 engages the base end cap flange 50 so as to be deflected toward the piston into engagement with the base end 84 of poppet 68 thereby tripping the same and establishing fluid communication through the poppet sleeve 66.

Accordingly, the poppet trip device or spring clip 86 of the present invention enables the poppet to be tripped at the retracted position for the piston in much the same manner as at the extended position for the piston even though the cylinder base end 16 is recessed so as to prevent direct engagement with the poppet 68. The spring clip arm 92 enables the poppet to indirectly engage the base end cap flange 50 for tripping of the poppet in response to movement of the piston to its fully retracted position.

The positioning of the poppet sleeve 66 and poppet 68 at a position radially intermediate the piston rod 22 and cylinder 12 enables the piston assembly to be easily and economically manufactured and installed. Furthermore, the operation of the poppet of the present invention is easy to understand thereby rendering less technical any field repair which may be necessary. Finally, both the poppet 68 and both valves seats 70 and 74 are formed of steel or a material of at least equivalent hardness so as to have little or no susceptibility to contamination due to the embedding of foreign matter carried in the high velocity fluid passing through the poppet sleeve 66 at the end of each stroke of the piston.

Whereas the poppet trip device is shown in the preferred embodiment as carried on the piston rod, it is contemplated that in alternate embodiments, it may be fixed to the cylinder base end for engagement with the base end of the poppet when the piston is moved to its retracted position.

Accordingly, there has been shown and described a hydraulic cylinder unit including a poppet trip device which accomplishes at least all of the stated objects.

I claim:

1. A hydraulic cylinder unit comprising, an elongated cylinder having a head end and a base end, a piston rod slidably extended through said head end, a piston mounted on said rod interiorly of said cylinder, said piston including a generally axially extended poppet bore therethrough, said bore being radially offset from the axis of said piston rod at a position radially intermediate the piston rod and cylinder, a pair of oppositely disposed valve seats in said bore, a poppet supported within said bore for axial movement between said valve seats, said poppet including oppositely disposed valve heads adapted for seated engagement on said valve seats respectively in response to movement of said poppet in opposite directions, said poppet including head and base ends extended outwardly from said piston when said poppet is moved toward said cylinder head and base ends respectively, said head end of said poppet adapted for engagement with said cylinder head end in response to movement of said piston to said cylinder head end whereby said poppet is unseated and fluid communication is established through said poppet bore, a contact member radially positioned within said cylinder for engagement with said cylinder base end and base end of the poppet, and means for supporting said contact member at a position between said cylinder base end and piston for engagement with said base end of the poppet in response to movement of said piston rod to the cylinder base end whereby said poppet is unseated and fluid communication is established through said poppet bore, said contact member comprising a spring clip having a fixed generally flat portion and an arm extended from said fixed portion transversely across said cylinder for engaging said base end of the poppet, and said cylinder base end said arm being axially deflected relative to said fixed portion upon engagement with said cylinder base end.

2. The hydraulic cylinder unit of claim 1 wherein said contact member is carried on said piston rod for axial movement therewith.

3. The hydraulic cylinder unit of claim 2 wherein said spring clip is carried on said piston rod adjacent said piston, said spring clip being extended radially outwardly from said piston rod and toward said cylinder base end for deflection toward said piston when said piston rod is moved to said cylinder base end.

4. The hydraulic cylinder unit of claim 3 wherein said piston is secured on said piston rod by a retaining nut, said spring clip being secured between said retaining nut and piston.

5. The hydraulic cylinder unit of claim 2 wherein said piston rod includes a free end disposed within said cylinder and engageable with said cylinder base end, said piston being mounted on said rod in spaced relation from the free end thereof such that when the piston rod is moved to the base end of said cylinder, the base end of the poppet is spaced from said cylinder base end.

6. The hydraulic cylinder unit of claim 5 wherein said cylinder base end includes a base end cap extended axially into said cylinder adjacent the periphery of said cylinder, said contact member adapted to engage said cylinder end cap in response to movement of said piston rod to said cylinder base end.

7. The hydraulic cylinder unit of claim 2 wherein said fixed generally flat portion has an opening for receiving said piston rod therethrough.

8. The hydraulic cylinder unit of claim 7 wherein said arm is inclined relative to the plane of said flat portion.

9. The hydraulic cylinder unit of claim 7 further comprising means for limiting rotational movement of said spring clip relative to said piston in at least one direction.

10. The hydraulic cylinder unit of claim 1 wherein said pair of valve seats comprise valve surfaces having a hardness at least as hard as the lower end of the range of hardness of steel.

11. The hydraulic cylinder unit of claim 2 further comprising a hydraulic fluid port in said cylinder head end and base end, said ports being adapted for alternate communication with a source of hydraulic fluid under pressure whereby said piston is moved axially of said cylinder away from said port in communication with the hydraulic fluid source.

12. The hydraulic cylinder unit of claim 11 wherein said cylinder head end includes a recess positioned to provide fluid communication between said poppet bore and hydraulic fluid port of said cylinder head end when said piston is positioned at said cylinder head end.

* * * * *